US009361783B2

(12) United States Patent
Harvey

(10) Patent No.: US 9,361,783 B2
(45) Date of Patent: Jun. 7, 2016

(54) PERSON LOCATOR WITH IMBEDDED TRACKER AND PERSONAL IDENTIFICATION

(71) Applicant: Darcia Harvey, Chilliwack (CA)

(72) Inventor: Darcia Harvey, Chilliwack (CA)

( * ) Notice: Subject to any disclaimer, the term of this patent is extended or adjusted under 35 U.S.C. 154(b) by 0 days.

(21) Appl. No.: 14/326,031

(22) Filed: Jul. 8, 2014

(65) Prior Publication Data

US 2015/0009027 A1 Jan. 8, 2015

Related U.S. Application Data

(60) Provisional application No. 61/843,625, filed on Jul. 8, 2013.

(51) Int. Cl.

| | |
|---|---|
| ***G08B 1/08*** | (2006.01) |
| ***B65H 75/40*** | (2006.01) |
| ***A44B 11/00*** | (2006.01) |
| ***A45C 1/04*** | (2006.01) |
| ***A45F 3/00*** | (2006.01) |
| ***A44B 1/04*** | (2006.01) |
| ***G08B 25/01*** | (2006.01) |
| *G08B 21/02* | (2006.01) |

(52) U.S. Cl.
CPC ..... *G08B 25/016* (2013.01); *G08B 21/0269* (2013.01)

(58) Field of Classification Search
CPC ..... G08B 23/00
See application file for complete search history.

(56) References Cited

U.S. PATENT DOCUMENTS

| | | | | |
|---|---|---|---|---|
| 5,617,074 | A | 4/1997 | White | |
| 5,900,817 | A | 5/1999 | Olmassakian | |
| 6,243,039 | B1 * | 6/2001 | Elliot | 342/457 |
| 6,278,370 | B1 * | 8/2001 | Underwood | 340/573.1 |
| 6,396,403 | B1 | 5/2002 | Haner | |
| 7,511,627 | B2 | 3/2009 | Holoyda | |
| 7,693,512 | B1 * | 4/2010 | West | 455/417 |
| 8,150,371 | B2 * | 4/2012 | Lopez et al. | 455/411 |
| 2005/0020274 | A1 | 1/2005 | Ursini | |
| 2007/0078688 | A1 * | 4/2007 | Bischof et al. | 705/3 |
| 2007/0205235 | A1 * | 9/2007 | Knight et al. | 224/223 |
| 2012/0004894 | A1 * | 1/2012 | Butler et al. | 703/11 |
| 2012/0069511 | A1 * | 3/2012 | Azera | 361/679.03 |

* cited by examiner

*Primary Examiner* — Jennifer Mehmood
*Assistant Examiner* — Pameshanand Mahase
(74) *Attorney, Agent, or Firm* — Daniel Boudan; Global Intellectual Property Agency LLC

(57) ABSTRACT

Disclosed is a locator device that identifies a location of a person wearing or carrying the device, while providing a user with imbedded electronic feature to store personally identifiable information. The locator device takes the form of an article of jewelry or a retractable keychain, which may be provided in various ornamental designs having a housing member. Within the housing member of the device may include a GPS transceiver chip and an identifying integrated circuit that stores personally identifiable information. The housing member further includes an internal battery that provides electrical power when the device is utilized. The purpose of the device is to provide an aesthetically pleasing accessory while providing a discrete locator device that includes identifiable information of the person wearing or carrying the same.

9 Claims, 5 Drawing Sheets

PERSON LOCATOR WITH IMBEDDED TRACKER AND PERSONAL IDENTIFICATION

CROSS REFERENCE TO RELATED APPLICATION

This application claims the benefit of U.S. Provisional Application No. 61/843,625 filed on Jul. 8, 2013. The above identified patent application is herein incorporated by reference in its entirety to provide continuity of disclosure.

BACKGROUND OF THE INVENTION

1. Field of the Invention

The present invention relates to combination ornamental accessory and person locator device. More specifically, the present invention pertains to an article of jewelry or retractable key chain that comprises a GPS transceiver and an identifying integrated circuit. The device may be provided in the form of a watch, necklace, pendant, anklet, bracelet, or a key chain having a housing member adapted to enclose the electronic features of the present invention.

There are various types of support services needed to provide proper supervision of children, elderly, and those who are at risk or have special needs. It is difficult to supervise these individuals when they do not stay in one place, as many individuals travel from one location to another several times throughout the day. Additionally, it is difficult to locate these individuals when they leave a designated area in which they are allowed. When the supervised individual ventures out alone, the individual may get lost and the caretaker may be unable to locate the individual. This is particularly problematic when the individual suffers from mental illness such as Alzheimer's disease, dementia, or another such cognitive disability, as the individual may pose a threat to himself or to others.

For the foregoing reasons, a locator device for people can be a valuable asset for any caretaker. The present invention is a combination ornamental accessory and person locator device that contains identifiable information of a person. The person locator device of the present invention is designed to be small and lightweight, so that it is convenient to carry or wear. For instance, the present invention may be easily placed in a purse, a bag, or other objects kept with the monitored person. Alternatively, the present invention may be worn. The person locator device automatically provides real-time updates of the location of the monitored person over the Internet. Accordingly, the user may check the location of the person from any electronic device having an Internet connection. The present invention can bring a sense of security to any caretaker. The present invention is ideal for use with children, elderly, or with those who are at risk or have special needs.

The primary advantage of the present invention is not only its outward ornamental design and tracking capability, but more specifically the identifying integrated circuit feature within the housing member. The integrated circuit allows the device to store personally identifiable information such as name, birthday, address, and phone number of the monitored person. Additionally, the integrated circuit allows the device to store medical information of the person, such as blood type, allergies, medical diseases and conditions, and the like. In this way, the present invention alerts emergency medical personnel of relevant medical information of the monitored person.

2. Description of the Prior Art

Devices have been disclosed in the prior art that relate to locators and monitoring systems for use with people. These include devices that have been patented and published in patent application publications. Some of these patents describe a portable device that utilizes GPS to monitor the position of a person. Another patent describes a combination GPS and camera transmitting assembly for tracking and providing audible and visual contact with a person. These devices, however, do not include a microprocessor that can store personally identifiable information and personal medical information that may be used during a medical emergency. The following is a list of devices deemed most relevant to the present disclosure, which are herein described for the purposes of highlighting and differentiating the unique aspects of the present invention, and further highlighting the drawbacks existing in the prior art.

For example, U.S. Pat. No. 5,617,074 to White discloses a child finder comprising a transmitter that is adapted to send a signal to a conventional receiver so that the child's location may be monitored. The transmitter may be enclosed in an article of jewelry such as a watch, bracelet, ring, or the like. The transmitter may be turned on or off via a push button so that the transmitter may be activated as needed. The push button comprises a safety mechanism so that the transmitter may not be inadvertently turned off. While White discloses a child finder constructed as an article of jewelry, it does not utilize a GPS to locate the child wearing the device. Rather, the child finder device of White utilizes a conventional transmitter and receiver that may be unable to communicate with each other. In this way, the device of White may be unable to monitor the child's location. In contrast, the present invention discloses a person locator device that utilizes GPS to receive radio signals that the GPS satellites broadcast. The present invention communicates with at least four GPS satellites that are visible at any time, thereby allowing the device to transmit information about its position and the current time at regular basis.

U.S. Pat. No. 6,396,403 to Haner discloses a child monitoring system comprising a combination bracelet and camera transmitting assembly. The system further comprises a receiver for tracking and providing audible and visual contact with a child or object within a predetermined area. The bracelet is preferably worn on a child's wrist, and it includes a transmitter that transmits signals for detection by a remote hand-held or belt worn monitor. The bracelet also includes a circuitry for two-way speaker communication or monitoring. The camera transmitting assembly is worn on an article of clothing worn by the child so as to provide a video signal. The device may employ GPS microminiaturized technology when monitoring the child at a longer distance.

The device of Haner, however, does not disclose a retractable transmitting assembly that is adapted to store personally identifiable information and personal medical information. The present invention discloses a person locator device that is enclosed in a retractable housing. The locator device is adapted to monitor the location of a person and store personally identifiable information. The personally identifiable information allows a user to verify the name, birthday, gender of the monitored person. Additionally, the locator device of the present invention stores medical information of the monitored person. In this way, the locator device alerts emergency medical personnel as to the medical condition of the monitored person.

Another device, U.S. Pat. No. 6,243,039 to Elliot discloses a child locator system comprising a GPS locator device. The GPS locator device is carried or worn by a child, and a parent can monitor the location of the child by logging onto a website or by calling into a call center. The parent can customize the setting so that he or she can receive an automatic notification when a child moves outside of a pre-specified threshold. Additionally, the system may notify the parent when the child is near.

Similarly, U.S. Published Patent Application Number 2005/0020274 to Ursini discloses a portable child-locating device that utilizes GPS software. The device is rechargeable and may be in a form of an article of jewelry such as a bracelet, pendant, watch, anklet, hair accessory or pocket item. The child may be tracked on a computer or a portable hand held electronic device that runs web browser software. Additionally, the device may be registered with a law enforcement agency to enable the user to report a child that is lost or abducted.

While the foregoing devices disclosed in Elliot and Ursini utilize a satellite to locate and notify a law enforcement agency of a missing or abducted child, it does not notify emergency medical services of a medical condition of a monitored person. The present invention stores personally identifiable information that includes medical information of a monitored person. The personally identifiable information may be recorded under a unique identification number. In this way, the present invention allows the law enforcement agency or emergency medical personnel to be aware of any pertinent medical condition of the monitored person.

U.S. Pat. No. 6,278,370 to Underwood discloses a child tracking apparatus that provides for the location of a child. The apparatus uses a small transmitter that is carried or worn by a child. The transmitter is enclosed in the child's clothing or personal adornments such as shoes, coats, watches, earrings, bracelets, rings, and the like. When the child is lost or is in danger, the child activates the transmitter. The transmitter communicates with a system of receivers such as local cellular telephone towers or low earth orbiting satellites, thereby sending a signal to a central reporting station. The central reporting station then notifies the parent of the child of the location of the child and assists the local law enforcement officials in locating the child. The device of Underwood, however, is limited in the fact that it requires a child to activate the transmitter. In contrast, the present invention does not need to be activated to provide continuous monitoring of a person, thereby allowing a user to track a person at all times.

U.S. Pat. No. 5,900,817 to Olmassakian discloses a monitoring system for a child. The system includes a first and second electronic module, wherein the first electronic module is worn or carried by a child, and an individual supervising the child carries the second electronic module. The first electronic module is adapted to exchange signals that determine the relative distance and direction the first electronic module is from a second electronic module. If the distance between the first and second electronic module exceeds a predetermined limit, the second electronic module alerts the supervising individual. Additionally, the second electronic module includes one or more screens that display the direction and distance between the two modules.

Finally, U.S. Pat. No. 7,511,627 to Holoyda discloses a child locator that comprises a master unit that is worn by a parent and a monitored unit that is worn by a child. The master unit is adapted to actuate its on-board alarm when its processor determines that the monitored unit is beyond a first predetermined distance. The monitored unit is adapted to actuate its on-board alarm when the monitored unit is beyond a second predetermined distance. Once an alarm on the monitored unit is activated, a signal from the master unit is required to deactivate it. The master unit may also include a directional antenna for determining a position on the monitored unit.

While the foregoing devices of Olmassakian and Holoyda allow a user to monitor the location of a child, these devices are limited in the fact that they require two electronic modules to communicate with each other to locate the child being monitored. In contrast, the present invention allows a user to track a person on any computer or a portable hand held electronic device that runs web browser software, thereby eliminating the need for the locator device to communicate with a paired electronic module.

These prior art devices have several known drawbacks. The prior art fails to disclose a retractable GPS transmitting assembly that is adapted to store personally identifiable information and personal medical information. The present invention discloses GPS transceiver and identifying integrated circuit. The identifying integrated circuit may be in a form of a microchip that is adapted to store personal and medical information of the monitored person. The identifying integrated circuit may use RFID technology and contain unique identification data and electronic circuits to encode that information. The device may be powered via an internal power source, such as battery, wherein the battery may be rechargeable. It is therefore submitted that the present invention substantially diverges in design elements from the prior art, which overcomes the disadvantages of the prior art devices, and consequently it is clear that there is a need in the art for an improvement to existing locators and monitoring systems for use with people. In this regard the instant invention substantially fulfills these needs.

SUMMARY OF THE INVENTION

In view of the foregoing disadvantages inherent in the known types of locators and monitoring systems for use with people now present in the prior art, the present invention provides a new improvement to an ornamental person locator with imbedded tracker and personal identification wherein the same can be utilized for determining the location of a person and identifying relevant medical condition of the person being located.

It is therefore an object of the present invention to provide a new and improved combination ornamental accessory and person locator device that has all of the advantages of the prior art and none of the disadvantages.

It is another object of the present invention to provide a new and improved combination ornamental accessory and person locator device that is in the form of a jewelry article or a retractable key chain having a housing member that encloses the electrical components of the device.

Another object of the present invention is to provide a new and improved combination ornamental accessory and person locator device that can alert a law enforcement agency, emergency medical services, or the user of the location of the monitored person.

Yet another object of the present invention is to provide a new and improved combination ornamental accessory and person locator device having GPS transceiver that transmits and receives information about its position and the current time at regular intervals.

Still yet another object of the present invention is to provide a new and improved combination ornamental accessory and person locator device having an identifying integrated circuit that stores personally identifiable information and personal medical information of the monitored person.

Still yet another object of the present invention is to provide a new and improved combination ornamental accessory and person locator device that allows a user to view and verify the location of the monitored person on a computer or a portable hand held electronic device that runs web browser software.

Still yet another object of the present invention is to provide a new and improved combination ornamental accessory and person locator device that is powered by a battery.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and in manner in which it may be made and used may be better understood after a review of the following description, taken in connection with the accompanying drawings wherein like numeral annotations are provided throughout.

DETAILED DESCRIPTION OF THE INVENTION

Figure 1A:
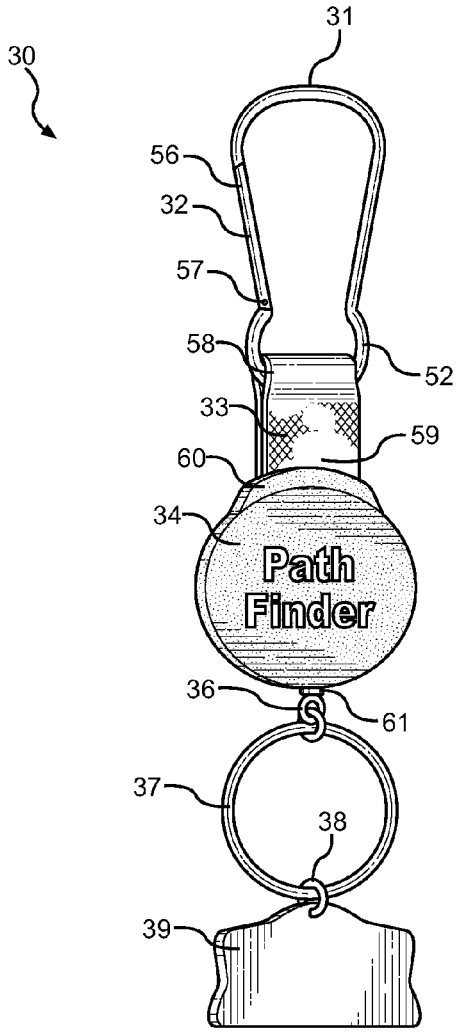
FIG. 1A shows a view of the present invention in a retracted position.

Reference is made herein to the attached drawings. Like reference numerals are used throughout the drawings to depict like or similar elements of the combination ornamental accessory and person locator device. For the purposes of presenting a brief and clear description of the present invention, the preferred embodiment will be discussed as used for utilized for determining the location of a person and identifying relevant medical condition of the person being located. The figures are intended for representative purposes only and should not be considered to be limiting in any respect.

Figure 1B:
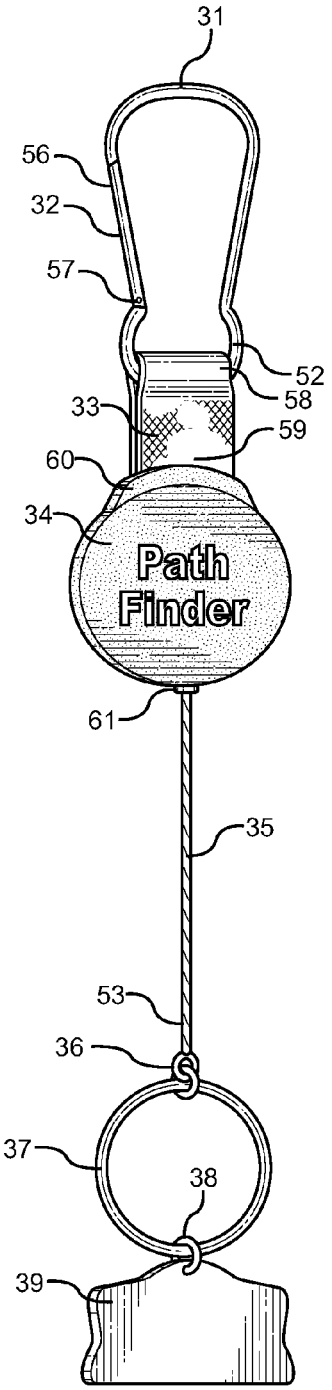
FIG. 1B shows a view of the present invention in an extended position.

Referring now to FIGS. 1A and 1B, there are shown views of the combination ornamental accessory and person locator device of the present invention in retracted and extended positions. The illustrated embodiment of the combination ornamental accessory and person locator device 30 comprises a retractable key chain that may be easily carried by the monitored person. The device 30 comprises a steel or aluminum carabiner 31 having a gate 32 and a lower portion 52. The carabiner 31 may be oval-shaped, pear-shaped, D-shaped, or offset D-shaped. The gate 32 has an attachment end 57 and an opening end 56, wherein the attachment end 57 is hinged to the carabiner so that it opens inwardly. In the illustrated embodiment, the present invention comprises a straight gate that is composed of a straight piece of solid aluminum or steel. As such, the gate 32 is straight from the hinge to the closure point. In other embodiments, however, the gate may be a bent gate or a wire gate, which may be non-locking or locking. The carabiner 31 has a hollow middle so as to allow a user to hook the carabiner 31 onto a belt loop, purse, bag, or other objects kept with the monitored person. The lower portion 52 of the carabiner 31 is attached to an attachment strap 33.

The attachment strap 33 may be composed of nylon, polypropylene, cotton webbing, or other suitable webbed fabric material. The attachment strap 33 comprises a top end 58 and a lower end 59, wherein the top end 58 is threaded through the carabiner 31 and folded onto itself to form a closed loop. The lower end 59 of the strap 33 is attached to the top portion 60 of the retractable key chain. The retractable key chain comprises a casing body 34 that includes a printed design or wording on its exterior surface. The casing body 34 houses a retractable metal chain 35 that may be composed of stainless steel. In alternate embodiments, stainless steel braided wire or cable may be used instead of the metal chain 35. The chain 35 is threaded through a small aperture disposed on the lower portion 61 of the casing body 34. The chain 35 is able to extend and retract via a spring winding that is enclosed within the casing body 34. The terminal end 53 of the retractable metal chain 35 is connected to a key ring 37 via an attachment loop 36 attached thereon. The key ring 37 may be a spiral key ring having an edge that is adapted to lift upwards so as to allow the attachment loop 38 of the housing member 39 to slide under part of the key ring 37.

Figure 2:
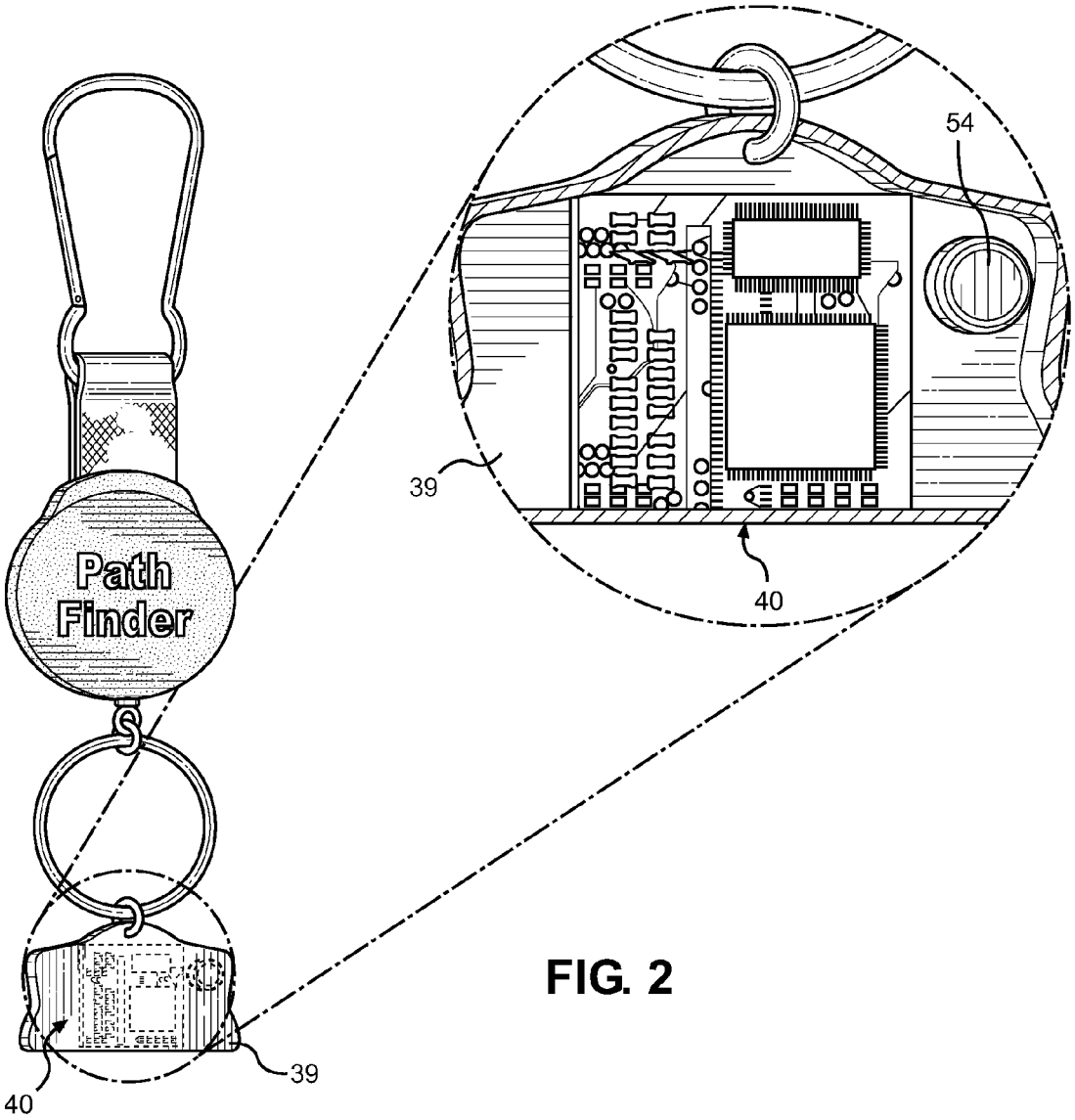
FIG. 2 shows a cutout view of the housing member of the present invention.

Referring now to FIG. 2, there is shown a cutout view of the housing member 39 of the present invention. In the illustrated embodiment, the housing member 39 is a modified pentagon resembling a house. The housing member 39 comprises rigid material such as metal, plastic, or other suitable material. The housing member 39 may comprise two identical juxtaposed pieces that are secured together and sealed around its perimeter to form an interior volume. The interior volume is adapted to receive electrical elements 40 that provide functionality of the device.

The electrical elements 40 comprise a chip having a substantially rectangular plate and a set of electronic circuits thereon. The electrical elements 40 may comprise one or more chips composed of a semiconductor material, such as silicon. The circuit elements of the chips are inseparably associated and electronically interconnected so that it is considered to be indivisible for the purposes of construction. The electrical elements 40 are very compact and are constructed to fit within the interior volume of the housing member 39. The electrical elements 40 comprise a GPS transceiver, a microprocessor, and an identifying integrated circuit, which is adapted to store personal information of a monitored person who is wearing or carrying the device. The electrical elements 40 are powered by a battery 54. Accordingly, the housing member 39 is adapted to enclose the battery 54 therein.

Figure 3:
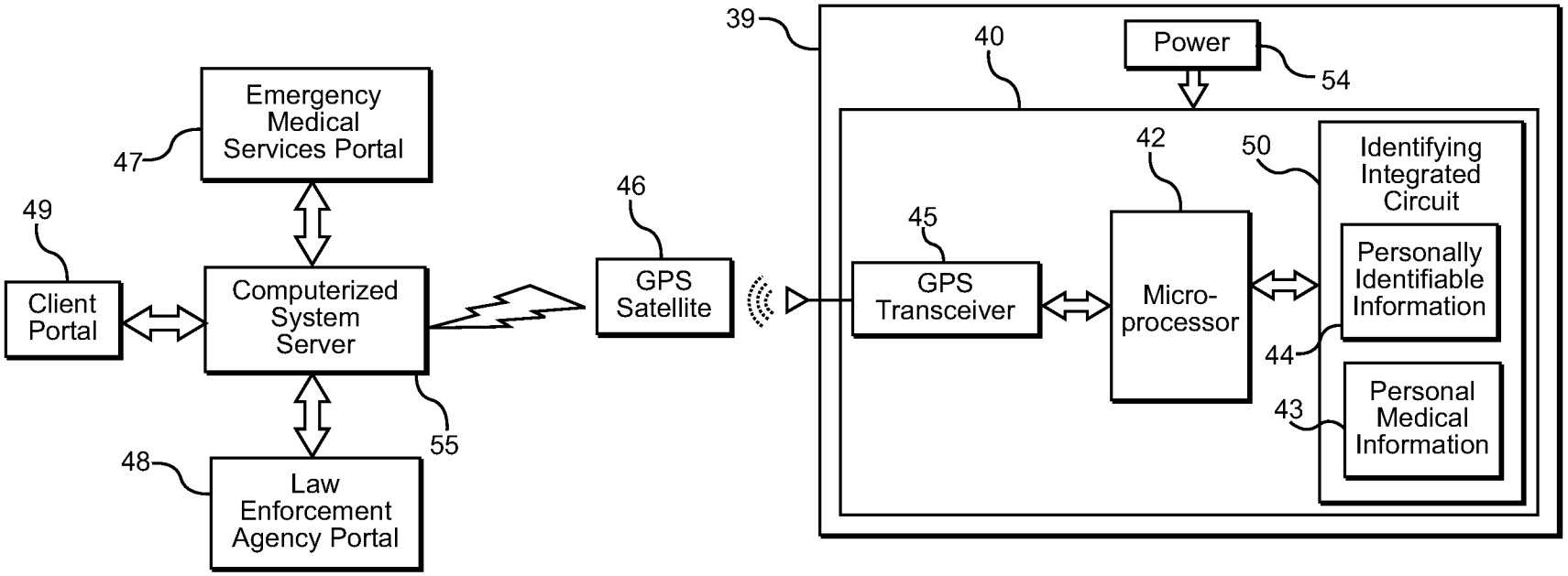
FIG. 3 shows a schematic flow diagram of the electrical components within the housing.

Referring now to FIG. 3, there is shown a schematic flow diagram of the electrical elements 40 within the housing member 39 comprising a microprocessor 42 and a GPS transceiver 45. The GPS transceiver 45 is adapted to communicate with a GPS satellite 46. More specifically, the GPS transceiver 45 transmits an outgoing signal to the GPS satellite 46. Radio waves propagate a given distance during this transmission and are received by the GPS satellite 46. Once the outgoing transmission initiates, the time of transmission is marked by the microprocessor 42. The GPS satellite 46 accepts the incoming transmission from the GPS transceiver 45 of the present invention and sends a signal to back to the GPS transceiver 45. Thereafter, the GPS transceiver 45 receives an incoming signal from the GPS satellite 46. When the incoming transmission terminates, the time of receipt is marked by the microprocessor 42. The microprocessor 42 is adapted to interpret incoming signals, make calculations based on input information, and thereafter determine output information. Accordingly, the microprocessor 42 uses the time of transmission and the time of receipt to calculate the distance and direction between GPS satellite and the housing member 39. Because the housing member 39 is attached to the present invention that is carried or worn by a monitored person, locating the housing member 39 allows a user to locate the monitored person.

The electrical elements 40 of the present invention further include an identifying integrated circuit 50. The identifying integrated circuit 50 may be in the form of a microchip, which includes an internal data storage that include personally identifiable information 44 and personal medical information 43 of the person being monitored. The personally identifiable information 44 may include name, date of birth, sex, address of home of record, phone number, among other things. The personally identifiable information 44 allows a user to verify the identity of the person being monitored. Additionally, personal medical information 43 may include relevant medical information of the person being monitored, such as the person's blood type, allergies, medical diseases and conditions, medical doctor contact information, and the like. The medical information 43 allows emergency medical personnel accommodate to the medical needs of the person being monitored in cases of emergency. The identifying integrated circuit 50 may use passive Radio Frequency Identification (RFID) technology or other suitable method that allows a user to program the person's medical information via the microprocessor 42.

When the personally identifiable information 44 and personal medical information 43 are programmed into the identifying integrated circuit 50, the information 43, 44 may be saved under a unique identifier number. This information may be accessed via a scanner or other electronic device that is adapted to receive the data. The GPS transceiver 45, the identifying integrated circuit 50, and the microprocessor 42 are powered via a battery 54. The battery 54 is preferably a flat round battery that is adapted to fit within the interior volume of the housing member 39. The battery 54 may be rechargeable or replaced as needed by the user.

The GPS satellite 46 is adapted to communicate with a computerized system server 55 on the ground. In other embodiments, the GPS satellite 46 may transmit signals to a satellite tower or an antenna tower of a ground station, wherein the ground station can communicate with the computerized system server 55. The computerized system server 55 is adapted to communicate with a client portal 49 and one or more third party portals via the Internet and/or a local area network (LAN). In the illustrated embodiment, the computerized system server 55 acts as a centralized server. In other embodiments, however, one or more servers may be utilized as needed to increase the speed and efficiency of communication.

The client portal 49 is accessible by the user who is supervising the monitored person. The user may access the client portal 49 by logging onto a website or a webpage. In this way, the user may access the client portal 49 from any electronic device having web-browsing capabilities, which provide convenience to the user. For instance, the user may access the client portal 49 via a computer or a hand held device such as a smart phone. The website or the webpage may require the user to register the device so that the device may correspond to the location and information pertaining to the monitored person.

The third party portals may include an emergency medical services portal 47 and a law enforcement agency portal 48. Similar to the client portal 49, the emergency medical service portal 47 and the law enforcement agency portal 48 may be in a form of a website, or it may be in a form of a database that is commonly used by emergency medical services and law enforcement agencies. The portals 47, 48 allow the emergency medical services and law enforcement agencies to view the location of the monitored person. Additionally, the emergency medical services portal 47 may allow emergency medical personnel to access the medical information of the monitored person in order to accommodate to the particular medical needs of the person. This may be particularly useful if the person being located suffers from a relevant medical illness that requires an immediate attention, such as a heart condition or dementia. Similarly, the law enforcement agency portal 48 may allow a law enforcement officer to access personally identifiable information of the monitored person in order to obtain a background information of the person. In this way, the law enforcement officer may contact the monitored person's family member or a supervising individual.

Figure 4:
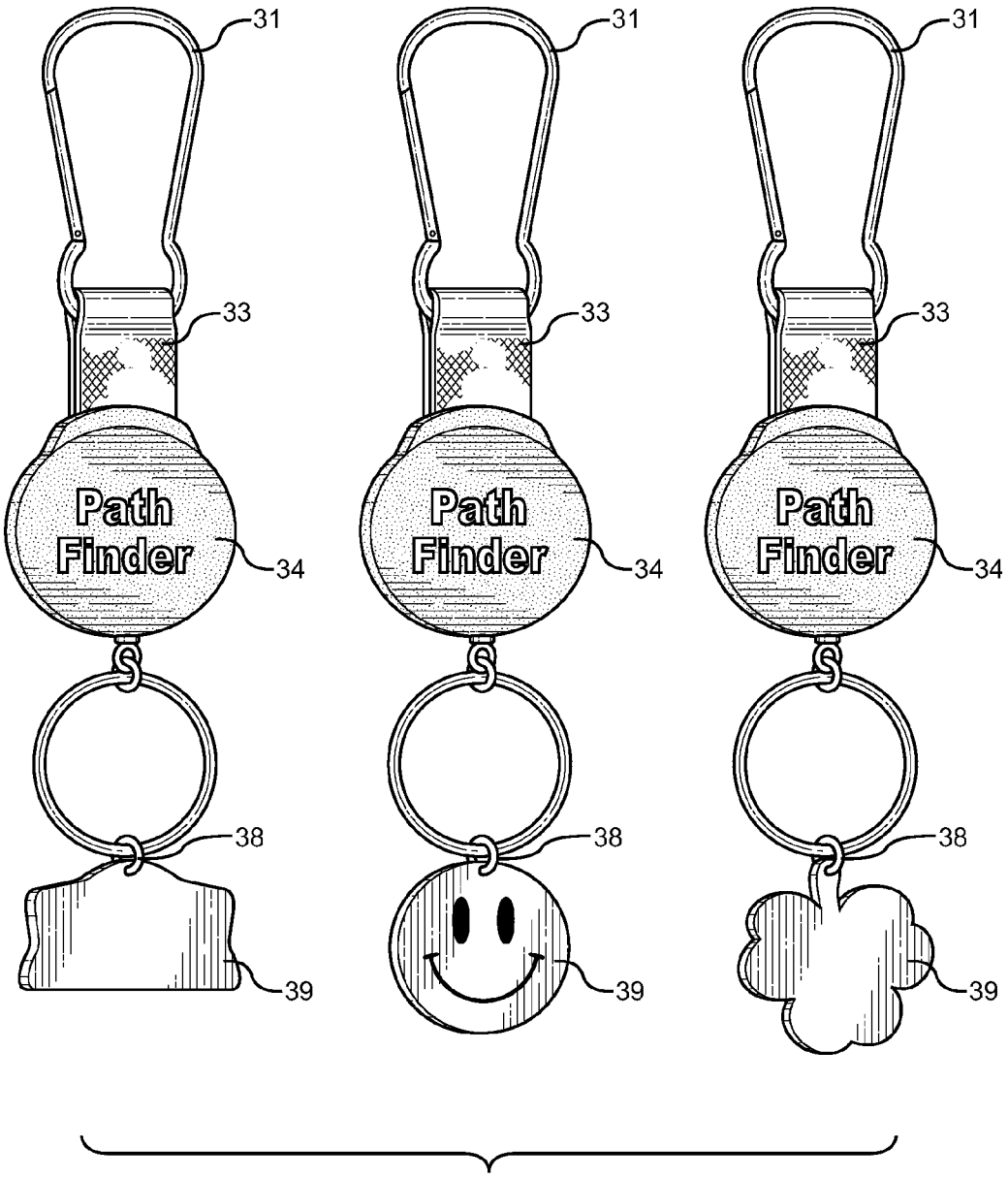
FIG. 4 shows a view of different embodiments of the present invention.

Referring now to FIG. 4, there are shown views of different embodiments of the present invention. The housing member 39 may take any shape desired by the user, including a house-shape, disk-shape, or cloverleaf-shape. The housing member 39 may also comprise various colors. Additionally, the body of the retractable key chain 34, the attachment strap 33, and the carabiner 31 may also comprise various colors to match the color of the housing member 39. This provides the user with the ability to utilize the combination ornamental accessory and person locator device 30 for both its ornamental qualities as a retractable key chain, while providing means to locate a person and store his or her personal information, which is useful for emergency medical personnel when attending to a medical need of the person.

Figure 5A:
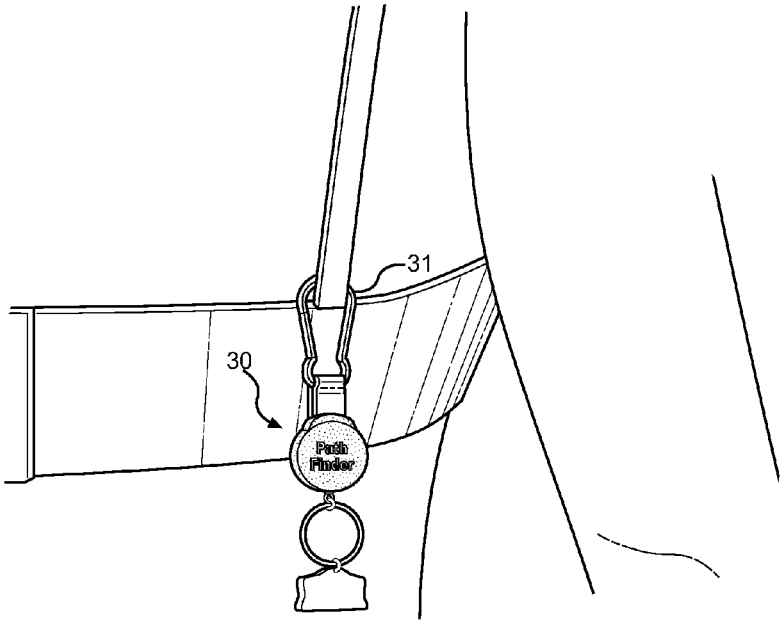
FIG. 5A shows a view of the present invention as worn on an undergarment.
Figure 5B:
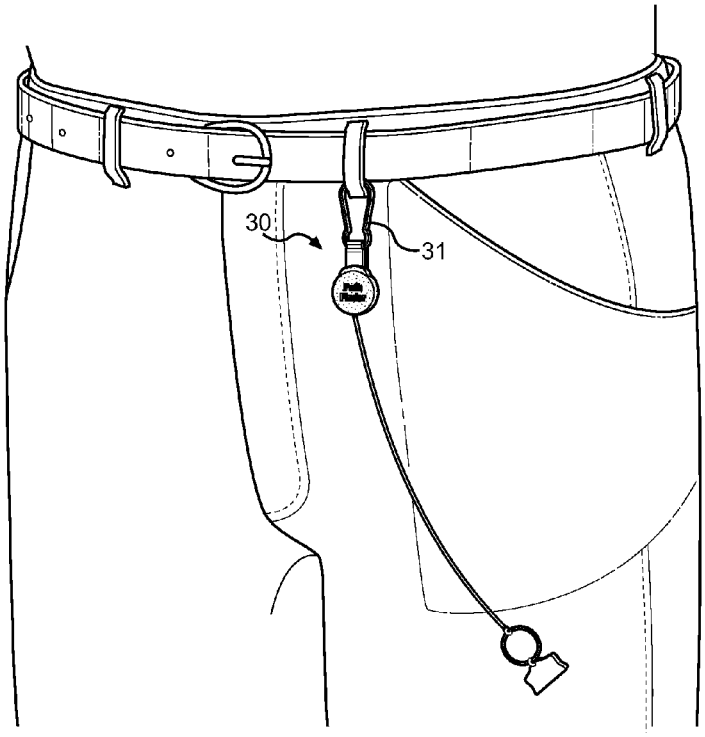
FIG. 5B shows a view of the present invention as worn on a belt loop.

Referring now to FIGS. 5A and 5B, there are shown views of the combination ornamental accessory and person locator device 30 as worn by users. The carabiner 31 of the present invention may be used to clip the device onto the user's clothing or items carried by the user. More specifically, the carabiner 31 may be clipped onto an undergarment such as a bra strap so that it may be worn under clothing. In this way, the present invention is discrete when it is worn. Alternatively, the present invention may be worn over clothing. For instance, the carabiner 31 may attach onto a belt loop. The housing of the device may be extended so as to allow the user to insert the housing inside the user's pocket. In use, the present invention serves as a unique accessory for the user, providing ornamental features that one may find attractive, while also providing functionality in the form of a person locator and storage for personal information.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination ornamental accessory and person locator device, comprising:

a housing member having an attachment loop, a GPS transceiver, an identifying integrated circuit, and a microprocessor;

said GPS transceiver, said identifying integrated circuit, and said microprocessor being battery powered;

said identifying integrated circuit adapted to store personally identifiable information and personal medical information;

a carabiner having a gate and a lower portion;

a casing body having a retractable cord and a retractable reel enclosed in said casing body;

a top portion of said casing body being attached to said carabiner;

a key ring attached to a terminal end of said retractable cord;

said attachment loop of said housing member connected to said key ring.

2. The combination ornamental accessory and person locator device of claim 1, further comprising:

a GPS transceiver adapted to transmit an outgoing signal to GPS satellite and receive an incoming signal from said GPS satellite;

said microprocessor is adapted to interpret said incoming signal and said outgoing signal for calculation of a distance and a direction between said GPS satellite and said housing member.

3. The combination ornamental accessory and person locator device of claim 1, further comprising:

an attachment strap having a top end and a lower end;

said top end of said attachment strap threaded through said carabiner and folded onto itself to form a closed loop around said lower portion of said carabiner;

said lower end of said attachment strap attached to a top portion of said casing body.

4. The combination ornamental accessory and person locator device of claim 1, wherein said identifying integrated circuit is a microchip.

5. The combination ornamental accessory and person locator device of claim 1, further comprising:

a computerized system server;

a client portal in communication with said computerized system server;

at least one third party portal in communication with said computerized system server.

6. The combination ornamental accessory and person locator device of claim 5, wherein said least one third party portal is a law enforcement agency portal.

7. The combination ornamental accessory and person locator device of claim 5, wherein said least one third party portal is an emergency medical services portal.

8. The combination ornamental accessory and person locator device of claim 5, wherein said client portal is adapted to display said personally identifiable information, said personal medical information, and a GPS position of said housing member.

9. The combination ornamental accessory and person locator device of claim 5, wherein said least one third party portal is adapted to display said personally identifiable information, said personal medical information, and a location of said housing member.

* * * * *